United States Patent [19]

Auxer et al.

[11] 4,006,832

[45] Feb. 8, 1977

[54] BUCKET DOOR SNUBBER

[75] Inventors: Marvin L. Auxer; Floyd E. McCann; Gerald D. Shepherd, all of Tulsa, Okla.

[73] Assignee: Unit Rig & Equipment Co., Tulsa, Okla.

[22] Filed: June 18, 1975

[21] Appl. No.: 587,951

[52] U.S. Cl. ..... 214/146 R; 37/118 R; 267/134; 267/135; 267/141; 294/69 R

[51] Int. Cl.[2] ..... E02F 3/81; E02F 3/84; F16F 7/00

[58] Field of Search ..... 37/118 R; 214/146 R, 214/145 R; 294/68, 69 R; 267/134, 135, 141, 152, 153; 151/29, 27

[56] References Cited

UNITED STATES PATENTS

| | | | |
|---|---|---|---|
| 146,325 | 1/1874 | Eaton | 294/69 R |
| 998,797 | 7/1911 | Palmer | 151/27 |
| 2,434,902 | 1/1948 | Burdick | 214/146 R |
| 3,059,793 | 10/1962 | Atkinson et al. | 214/146 R |
| 3,140,080 | 7/1964 | Rumsey | 267/134 |
| 3,437,332 | 4/1969 | Lee | 267/135 |
| 3,814,411 | 6/1974 | Aarons et al. | 267/152 X |

FOREIGN PATENTS OR APPLICATIONS

| | | | |
|---|---|---|---|
| 541,752 | 1/1932 | Germany | 214/146 R |
| 1,281,960 | 10/1968 | Germany | 214/146 R |
| 200,232 | 7/1923 | United Kingdom | 151/29 |

*Primary Examiner*—Edgar S. Burr
*Assistant Examiner*—Steven A. Bratlie
*Attorney, Agent, or Firm*—William S. Dorman

[57] ABSTRACT

Apparatus for dampening the closing of a heavy door of the type mounted along a hinge axis on a heavy movable member such as a digging bucket for a shovel, said dampening apparatus comprises a crank pivotally mounted intermediate its ends on said movable member adjacent said hinge axis, linkage means pivotally mounted adjacent one end thereof on said door and pivotally connected adjacent an opposite end to one end of the crank, a cushioning device having a lower pivotal connection pivotally connected to the crank at the end thereof opposite from the first-mentioned end and an upper pivotal connection pivotally connecting the cushioning device to the movable member, and the cushioning device comprises a telescopic rubber snubber.

4 Claims, 7 Drawing Figures

BUCKET DOOR SNUBBER

BACKGROUND OF THE INVENTION

1. Field of the Invention

The present invention relates to an apparatus for dampening the closing of a heavy door, such as the type of door which is pivotally mounted on the lower end of a bucket for a shovel. More particularly, the present invention involves a dampening device wherein the dampening effect is created by a plurality of rubber pads.

2. Description of the Prior Art

The problem to which the present invention is addressed is well recognized in the art. The bucket which is referred to in the present specification is normally attached to one end of a dipper stick which is mounted on a large piece of earth-moving equipment commonly referred to as a shovel. The opening of the bucket door presents no problem, because this door is merely opened by retracting a slidable rod or bolt whereby the door will open under its own weight plus the weight of any material contained within the bucket. Normally the door is closed by swinging the bucket in such a direction as to cause the door to move by inertia towards its closed position. However, when the door slams shut against the bucket, the impact, if not dampened, can cause damage to the door and/or the bucket. Devices for dampening the effect of the closing of the bucket door have been proposed in the past; however, these devices are generally hydraulic or pneumatic and have, for the most part, been unsatisfactory.

SUMMARY OF THE INVENTION

The present invention is designed to overcome the difficulties involved in attempting to dampen the movement of a bucket door using hydraulic or pneumatic means. The apparatus is used in conjunction with a heavy door of the type mounted along a hinge axis on a heavy movable member such as the bucket of a shovel and wherein the closing of this door is normally effected by moving the movable member in such a direction as to cause the door to swing by inertia about its hinge axis towards its closed position with respect to the movable member. The dampening apparatus comprises a crank pivotally mounted intermediate its ends on the bucket adjacent the hinge axis. Linkage means are pivotally connected at one to the bucket door and pivotally connected at the opposite end to one end of the crank. The cushioning device, which will be described in greater detail hereinafter, has a lower pivotal connection which is pivotally connected to the other end of the crank and has an upper pivotal connection which is pivotally connected to the bucket. The cushioning device includes an outer housing with a flat portion thereon, an inner housing telescopically received within the outer housing and having a flat end disposed adjacent the flat portion of the outer housing, bolt means connected at one end to the flat portion of the outer housing and extending through and beyond the flat end of the inner housing. Rebound rubber pad means are mounted on the bolt means between the flat portion of the outer housing and the flat end of the inner housing. A plurality of rubber pad means are mounted on the bolt means between the flat end of the inner housing and the other end of the bolt means, the latter being threaded. Washer means are mounted on the opposite end of the bolt means adjacent the rubber pad means and nut means are threadedly received on the bolt means adjacent the washer means and on the opposite side of the washer from the rubber pad means. The outer housing is integral with one of the pivotal connections for the cushioning device, for example, the upper pivotal connection. The inner housing is integral with the other of the pivotal connections for the cushioning device, for example, the lower pivotal connection. The geometry of the above arrangement is such that, as the bucket door moves past a predetermined position towards its closed position the lower pivotal connection on the cushioning device will move towards the movable member and beyond the line between the upper pivotal connection for the cushioning device and the intermediate pivotal connection for the crank whereby, when the door moves further past this predetermined position towards its closed position, the opposite end of the crank will exert a pulling force on the lower pivotal connection of the cushioning device to compress the plurality of rubber pads between the flat end of the inner member and the washer means.

The geometry of the above arrangement is also such that, as the door moves in the direction of its opening past the predetermined position referred to above, the lower end of the cushioning device will move away from the movable member and beyond the line between the upper pivotal connection for the cushioning device and the intermediate pivotal connection for the crank whereby, when the door moves further in its opening direction, the opposite end of the crank will exert a pulling force on the lower pivotal connection of the cushioning device to again compress the plurality of rubber pads between the flat end of the inner member and the washer means to retard any further opening of the door.

The invention also contemplates that the rubber pads which are located between the flat portion of the inner member and the washers can be preloaded to any predetermined degree of compression by turning the nuts in one direction or the other on the bolts. Keeper means are provided on the nuts to lock the nuts in position to retain the predetermined preloaded condition of compression

DESCRIPTION OF THE PREFERRED EMBODIMENTS OF THE INVENTION

Figure 1:
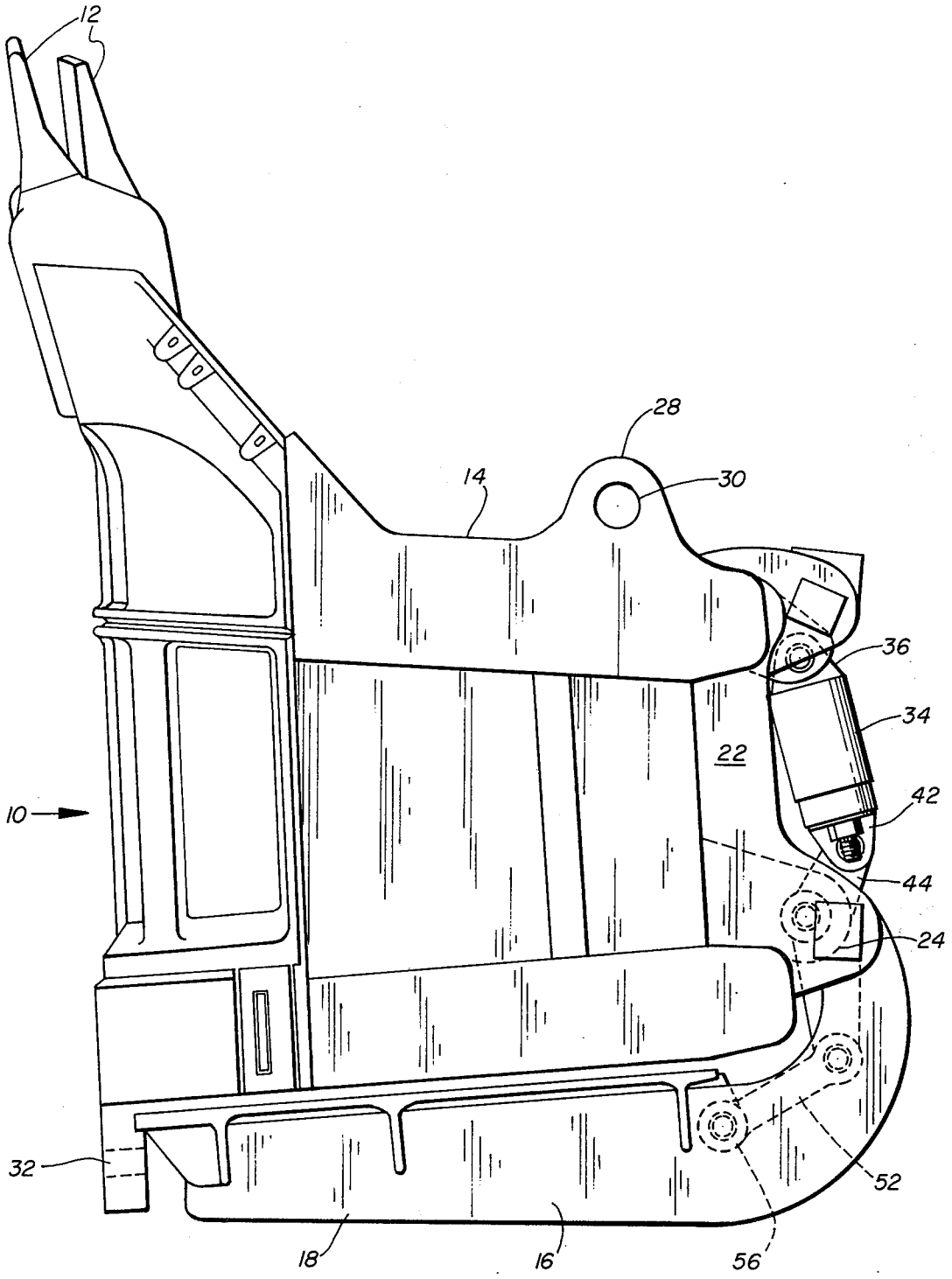
FIG. 1 is a side elevation of a bucket with the cushioning device or snubber of the present invention associated therewith.

Referring to the drawings in detail, FIG. 1 shows a bucket generally designated by the reference numeral 10. This bucket is of the type which is normally attached to the dipper stick (not shown) on a large digging machine (not shown) commonly referred to as a shovel. The details of the manner in which the bucket is attached to the stick are considered conventional and, hence, are not shown. The bucket 10 has digging teeth 12 in the upper end thereof and an open upper end 14 in which earth or other material is received after being dislodged by the teeth 12. The lower end of the bucket 10 is closed by a door 16 which is pivotally connected to the bucket in a manner to be described. The bucket door is provided with reinforcing arms 18 which are pivotally connected to the bucket at pivot connections generally designated by the reference numeral 20 and constituting the hinge axis for the door. Each pivot connection 20 includes a pair of spaced vertical braces 22 attached to the rear of the bucket 10. A large pin or bolt 24 passes through aligned holes in the braces 22 and arms 18.

Figure 2:
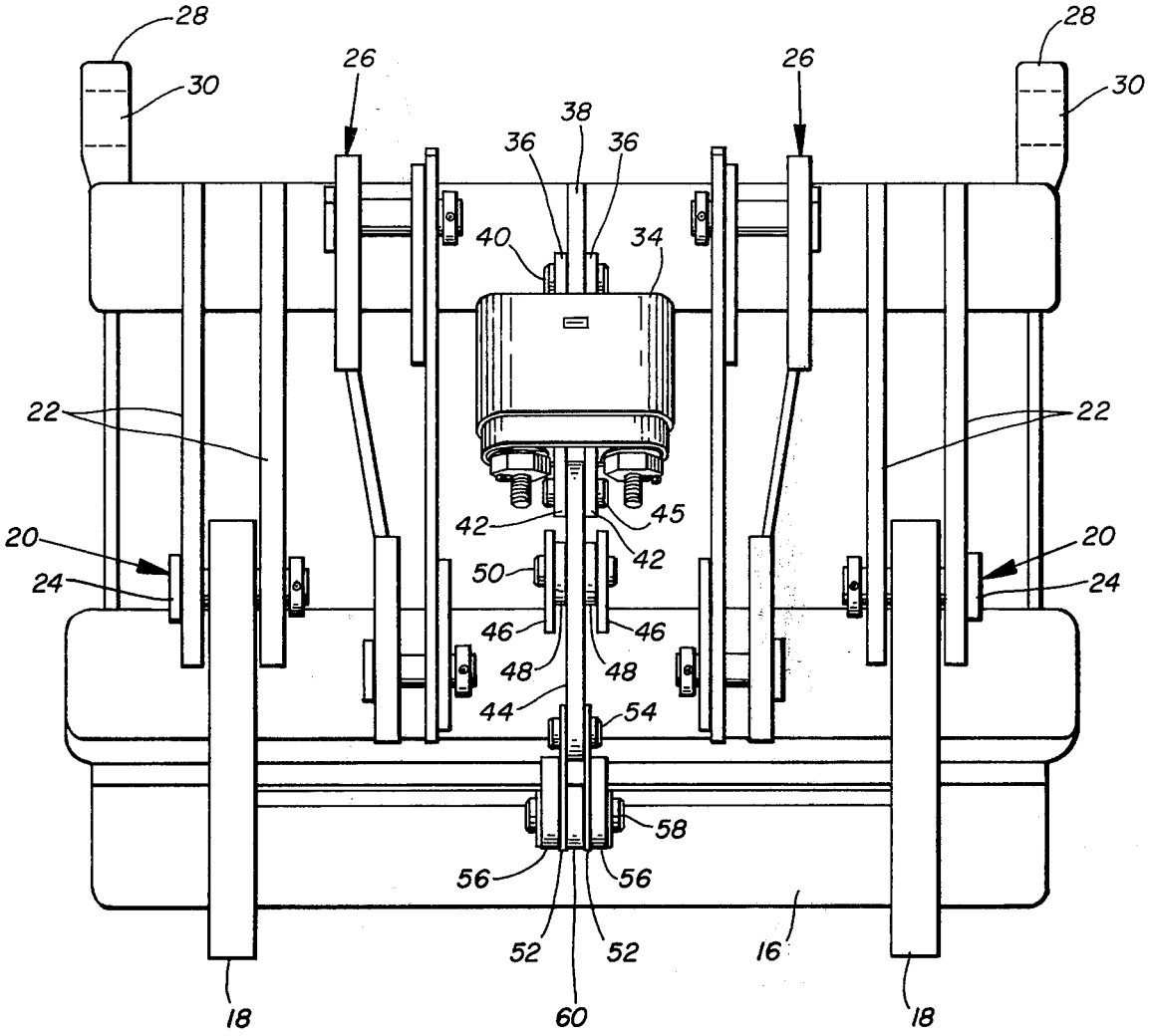
FIG. 2 is a rear view of the bucket shown in FIG. 1 with certain parts omitted for the sake of clarity.

FIG. 2 also shows a pair of brackets etc. generally designated by the reference numeral 26 for attaching the bucket to the dipper stick (not shown) of the shovel (not shown) in a manner considered to be conventional and, hence, not to be described in any further detail. FIG. 2 also shows a pair of lugs 28 having holes 30 therein to permit attachment of a bail (not shown). A cable (not shown) attached to the bail and also attached to a suitable winch (not shown) would be used for lifting the bucket or forcing the same into a body of dirt or other material.

The bucket 10 is also provided with an opening 32 in which a suitable latch member (not shown) can be received to lock the door 16 in the closed position shown in FIG. 1. The latch member is generally some type of slidable bar which is slidably mounted on the bottom of the bucket door. When the latch member (not shown) is retracted in the customary manner the bucket door 16 will open under its own weight and the weight of the material in the bucket resting on the door. The door will swing around the pivot connections 20. When it is desired to close the bucket door after the bucket has been emptied, it is the general practice to swing the bucket through an arc then to stop the swing of the bucket and allow the door to slam shut by inertia. However, the bucket doors are quite massive, as is also the case with the bucket itself. In order to prevent damage to the bucket, the bucket door and the pivot connections, it has been generally considered desirable to provide some means for dampening the swinging movement of the bucket door when it slams shut.

As shown in the drawings, the dampening means referred to above consists of a cushioning device or snubber 34, the inner details of which will be described hereinafter. The upper end of the snubber 34 is provided with a pair of spaced lugs 36 which straddle a lug 38 on the rear of the bucket 10. A pin or bolt 40 passes through aligned holes in the lugs 36 and 38 to provide an upper pivotal connection between the snubber 34 and the bucket 10. The lower end of the snubber is provided with a pair of lugs 42 which straddle the upper end of a crank 44. A pin or bolt 45 passes through aligned holes in lugs 42 and crank 44 to provide a pivotal connection between the lower end of the snubber 34 and the crank 44.

The crank 44 is pivotally connected, intermediate its ends, to the bucket 10 by means of a pair of spaced lugs 46 mounted on the rear of the bucket 10, a bolt or pin 50 passing through aligned holes in the lugs 46 and the crank 44 and a pair of spacers 48 which are received on the bolt 50 on opposite sides of the crank 44 and between the lugs 46. The lower end of the crank 44 is pivotally connected to a pair of links 52 by means of the pin or bolt 54 which passes through aligned holes in the links 52 and the crank 44. The opposite ends of the links 52 are pivotally connected to the door 16 by virtue of a pair of spaced lugs 56 on the door 16, a pin or bolt 58 passing through aligned holes in the links 52 and the lugs 56 and a spacer 60 received on the bolt 58 between the links 52.

Figure 3:
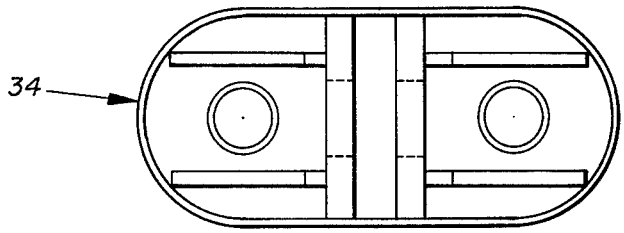
FIG. 3 is a plan view of the cushioning device or snubber per se.
Figure 4:
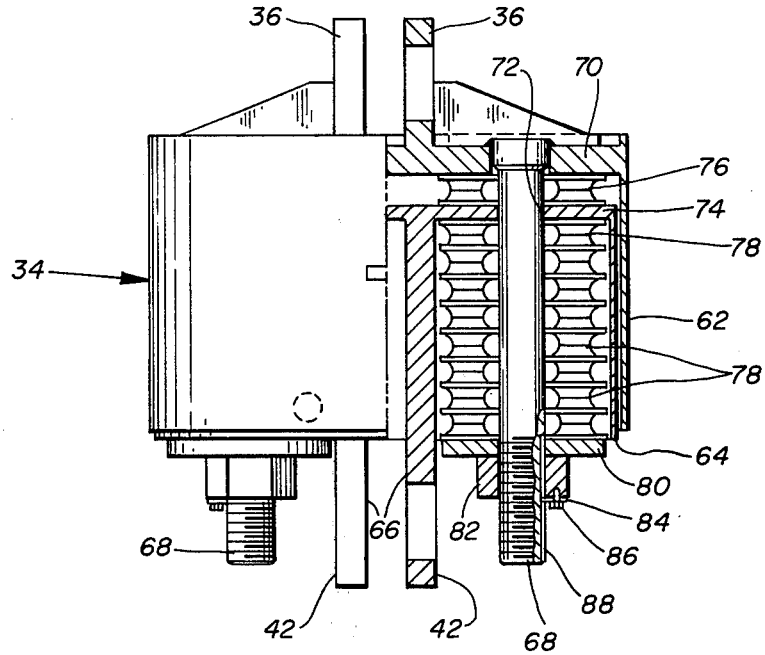
FIG. 4 is an elevation, with certain parts broken away for purposes of clarity, of the snubber shown in FIG. 3.
Figure 5:
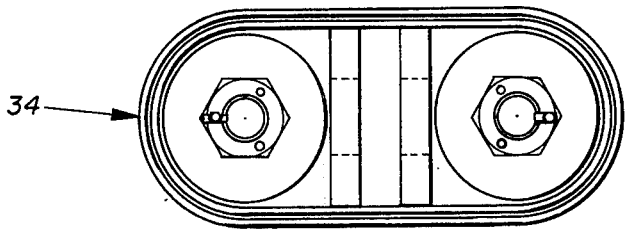
FIG. 5 is a bottom view of the snubber shown in FIG. 3.

Referring now particularly to FIGS. 3, 4 and 5, the snubber 34 consists of an outer member or housing 62 and an inner member or housing 64 which is telescopically received within the outer member. The lugs 36, previously described, are integral with the outer member 62. A pair of arms 66 extend downwardly from the top of the inner member 64; the lower ends of the arms 66 constitute the lugs 42, previously described. A pair of bolts 68 are attached to the upper flat portion 70 of the outer member 62 and extend through holes 72 in the upper flat end 74 of the inner member 64. A single donut shaped pad 76 is received on each of the bolts 68 between the ends 70 and 74 of the outer and inner members 62 and 64, respectively. A plurality of donut shaped pads 78 are received on each bolt 68 below the end 74 of the inner member 64. The pads 76 and 78 are made of rubber and, although shown in cross-section in FIG. 4, are not cross-hatched to indicate rubber for the sake of clarity. These pads 76 and 78 react in a fashion similar to a compression spring. The pads 78 are retained on the bolts 68 by means of a retainer plate or washer 80, and the washer is held on the bolt by means of a nut 82. The nut 82 can be prevented from rotating by means of a keeper 84 which is secured to the nut 82 by means of a screw 86. The keeper has a projection which is received in a longitudinal slot 88 in the bolt 68.

When the snubber 34 is placed under tension, as will hereinafter appear, the pads 78 are placed under compression; the rebound pads 76 dampen the movement of the inner member 64 towards the outer member 62 when the tension is abruptly released.

Figure 7:
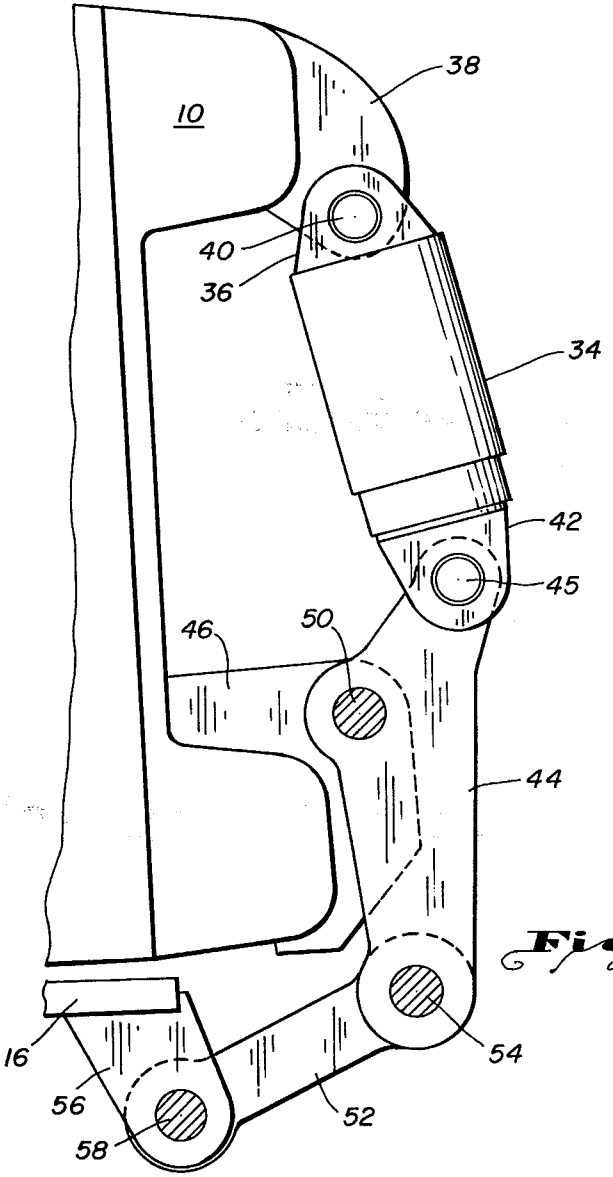
FIG. 7 is a view similar to FIG. 6, but showing the bucket door in a closed position.
Figure 6:
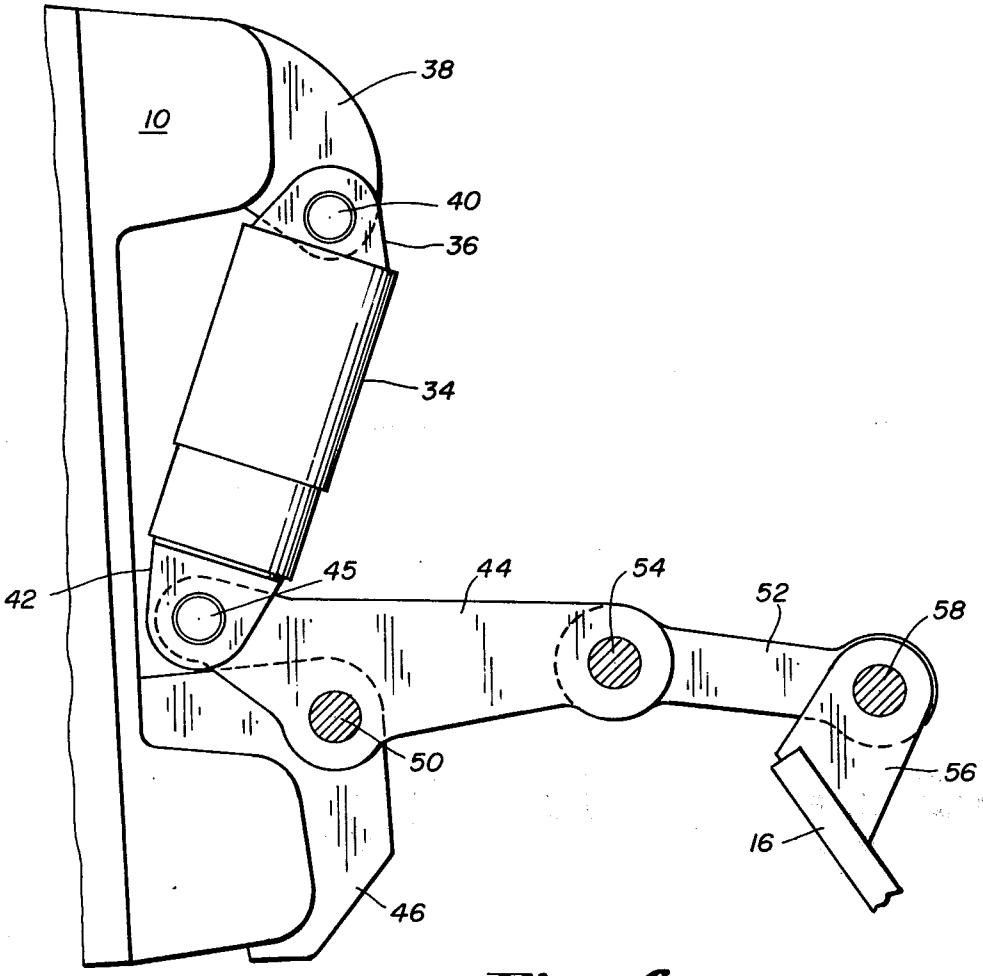
FIG. 6 is a semi-diagrammatic view, with certain parts in section and certain parts broken away, of the right-hand portion of FIG. 1 with the bucket door in the fully open position.

Turning now to a consideration of FIGS. 6 and 7, FIG. 6 represents a condition where the door 16 is in a fully open position, or beyond; FIG. 7 represents the fully closed position of the door 16. Comparing FIG. 6 with FIG. 7, it will appear that the lower pivot point of the snubber 34, as represented by the position of the bolt 45, is to the left of the line between the pivot points 40 and 50; however, in FIG. 7 the pivot point 45 is to the right of the line between the pivot points 40 and 50. In each case, however, the upper end of the crank 44 is exerting a downward or pulling force on the lower end of the snubber 34 so as to place the pads 78 in compression. Thus, the snubber 34 not only dampens the closing of the door 16, as will be further described in connection with FIG. 7, but it also prevents the door 16 from being opened too far as indicated in FIG. 6.

Returning again to a consideration of FIG. 7 in light of FIG. 4, the cushioning effect, when the door 16 is slammed shut, results from the compression of the pads 78. The pads are compressed between the flat end 74 of the inner member 64 and the washers 80. In this regard, it should be noted that the pads 78 can be preloaded to any desired degree of compression by virtue of the nuts 82 on the bolts 68. Thus, after an initial period of use of the snubber 34, it may be desirable to remove the keepers 84 from the bolts 82 and to tighten the bolts and then replace the keepers.

Whereas the present invention has been described in particular relation to the drawings attached hereto, it should be understood that other and further modifications, apart from those shown or suggested herein, may be made within the spirit and scope of this invention.

What is claimed is:

1. Apparatus for dampening the closing of a heavy door of the type mounted for swinging movement along a hinge axis, said hinge axis being located on a heavy movable member, and wherein the closing of the door is effected by moving the movable member in a direction to cause the door to swing by inertia about its hinge axis towards its closed position with respect to said movable member, wherein the improvement comprises a dampening apparatus including a crank having first and second opposite ends, said crank being pivotally mounted intermediate its ends on said movable member adjacent said hinge axis, linkage means pivotally mounted adjacent one end thereof on said door and pivotally connected adjacent an opposite end thereof to said first end of said crank, a cushioning device having a lower pivotal connection pivotally connected to said second end of said crank and an upper pivotal connection pivotally connecting said cushioning device to said movable member; said cushioning device having an outer housing with a flat portion thereon, an inner housing telescopically received within said outer housing and having a flat end disposed adjacent the flat portion of said outer housing, bolt means connected at one end to the flat portion of said outer housing and extending through and beyond the flat end of said inner housing, rubber pad means mounted on said bolt means between said flat portion and said flat end, a plurality of rubber pad means mounted on said bolt means between said flat end and the end of said bolt opposite from said one end thereof, said opposite end of said bolt means being threaded, washer means mounted on said opposite end of said bolt means adjacent said rubber pad means, and nut means threadedly received on said bolt means adjacent said washer means and on the opposite side thereof from said rubber pad means, said outer housing being integral with one of the pivotal connections for said cushioning device, said inner housing being integral with the other of said pivotal connections for said cushioning device; whereby, as said door moves past a predetermined position towards its closed position, the lower pivotal connection on said cushioning device will move away from said movable member and beyond the line between the upper pivotal connection for said cushioning device and the intermediate pivotal connection for said crank; and whereby, when said door moves further past said predetermined position towards its closed position, said second end of said crank will exert a pulling force on the lower pivotal connection of said cushioning device to compress said plurality of rubber pads between said flat end and said washer means.

2. Apparatus for dampening the closing of a heavy door as set forth in claim 1 wherein, as said door moves past said predetermined position in its direction of opening, the lower pivotal connection on said cushioning device will move towards said movable member and beyond the line between the upper pivotal connection for said cushioning device and the intermediate pivotal connection for said crank, whereby, when said door moves further past said predetermined position in its opening direction, said second end of said crank will exert a pulling force on the lower pivotal connection of said cushioning device to compress said plurality of rubber pads between said flat end and said washer means to retard further opening of said door.

3. Apparatus for dampening the closing of a heavy door as set forth in claim 1 wherein said plurality of rubber pad means mounted on said bolt means between said flat end and said washer means can be preloaded to a predetermined condition of compression by rotating said nut means on said bolt means.

4. Apparatus for dampening the closing of a heavy door as set forth in claim 3 wherein said nut means are provided with keeper means for locking said nuts in a predetermined position with respect to said bolt means.

* * * * *